US005232267A

United States Patent [19]

DeMatteo et al.

[11] Patent Number: 5,232,267

[45] Date of Patent: Aug. 3, 1993

[54] HIGH CHAIR SAFETY PANTS

[76] Inventors: Deborah DeMatteo, 8 Billwood Dr., Monroe, N.Y. 10950; George Spector, 233 Broadway RM 702, New York, N.Y. 10279

[21] Appl. No.: 950,136

[22] Filed: Sep. 24, 1992

[51] Int. Cl.[5] ..... A41D 13/04; A47C 31/00

[52] U.S. Cl. ..... 297/467; 2/75; 2/80; 2/400; 297/464

[58] Field of Search ..... 2/48, 49 R, 49 A, 75, 2/80, 400, 402, 403, 406, DIG. 6; 297/464, 465, 467, 485; 446/227, 901

[56] References Cited

U.S. PATENT DOCUMENTS 1,376,625 5/1921 Johnston ..... 2/49 R
2,657,688 11/1953 Tucker ..... 2/49 R
3,275,373 9/1966 Card ..... 297/467
4,627,587 12/1986 McCutchan et al. ..... 297/464 X
4,639,946 2/1987 Koenig ..... 2/DIG. 6 X
4,702,523 10/1987 Schrader et al. ..... 297/467 X

OTHER PUBLICATIONS

Gershman, Maurice, "Self Adhering Nylon Tapes." The J.A.M.A., vol. 168, No. 7, Oct. 1958.

*Primary Examiner*—Clifford D. Crowder
*Assistant Examiner*—Jeanette E. Chapman

[57] ABSTRACT

A high chair safety pants is provided which consists of a pair of pants for an infant. A first fastener member is applied to the bottom surface of the pair of pants. A second fastener member is applied to a seat of a high chair, which engages with the first fastener member to prevent the pair of pants with the infant from sliding off the seat of the high chair injuring the infant.

1 Claim, 1 Drawing Sheet

HIGH CHAIR SAFETY PANTS

BACKGROUND OF THE INVENTION

The instant invention relates generally to seating support devices and more specifically it relates to a high chair safety pants, which provides a fastener between the pants and the seat of the high chair to prevent an infant from sliding off the seat.

There are available various conventional seating support devices which do not provide the novel improvements of the invention herein disclosed.

SUMMARY OF THE INVENTION

A primary object of the present invention is to provide a high chair safety pants that will overcome the shortcomings of the prior art devices.

Another object is to provide a high chair safety pants that contains a fastener between the pants of an infant and a seat of the high chair to prevent the infant from sliding off the seat and injuring themselves.

An additional object is to provide a high chair safety pants, in which the fastener is VELCRO with one part secured to the bottom of the pants and the other part secured to the top of the seat of the high chair.

A further object is to provide a high chair safety pants that is simple and easy to use.

A still further object is to provide a high chair safety pants that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
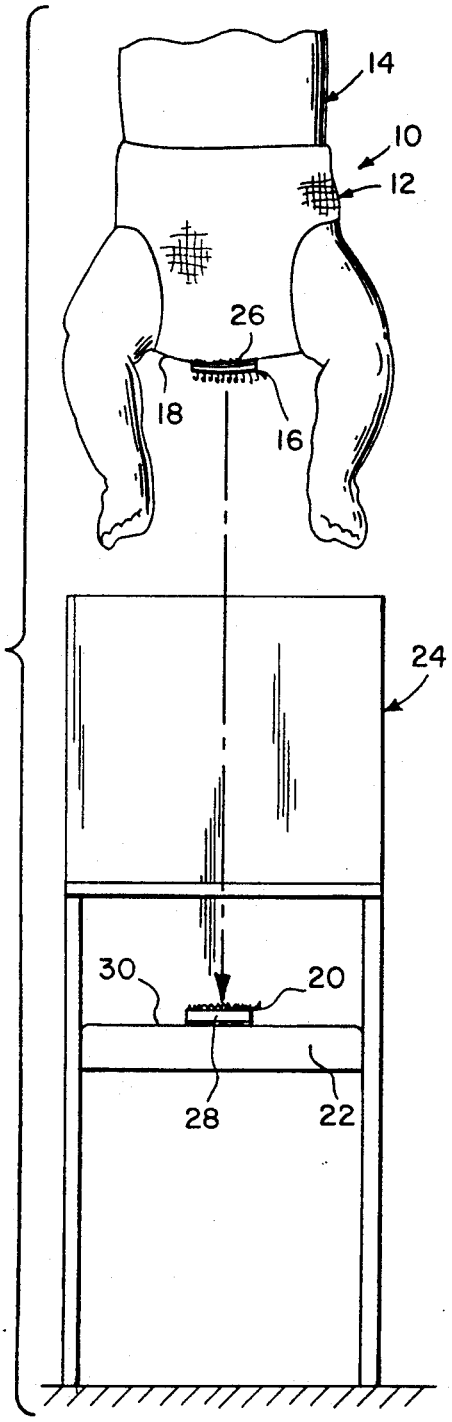
FIG. 1 is a front view showing an infant wearing pants with a VELCRO fastener part ready to be placed into a high chair to engage with another matching VELCRO fastener part on the seat.

Turning now descriptively, to the drawings, in which similar reference characters denote similar elements throughout the several views, the Figures illustrate a high chair safety pants 10, which consists of a pair of pants 12, for an infant 14. A first fastener member 16 is applied to the bottom surface 18 of the pair of pants 12. A second fastener member 20 is applied to a seat 22 of a high chair 24, which engages with the first fastener member 16 to prevent the pair of pants 12 with the infant 14 from sliding off the seat 22 of the high chair 24 and injuring the infant 14.

The first fastener member 16 is a first portion 26 of a hook and loop fabric fastener pad, attached with adhesive to the bottom surface 18 of the pair of pants 12. The second fastener member 20, shown in FIG. 1, is a second portion 28 of the hook and loop fabric fastener pad adhesively attached to a top surface 30 of the seat 22 of the high chair 24.

Figure 2:
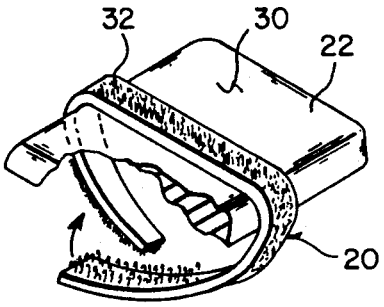
FIG. 2 is a perspective view of a second embodiment being an adjustable VELCRO fastener strap part placed upon the high chair seat.

As shown in FIG. 2, the second fastener member 20 is a hook and loop fabric fastener strap 32, that is adjustably attached about the seat 22 of the high chair 24.

Figure 3:
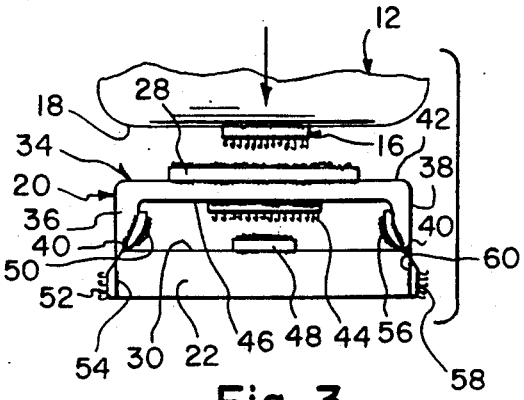
FIG. 3 is a front view of a third embodiment being a flexible clamp with VELCRO fasteners that engage the high chair seat when the weight of the infant presses down thereon.
Figure 4:
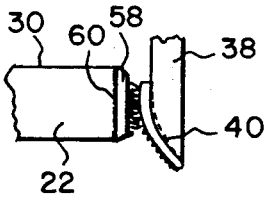
FIG. 4 is a partial front view of the third embodiment showing the position of the clamp after the infant sits down.

As shown in FIGS. 3 and 4, the second fastener member 20 includes a C-shaped clamp 34 having a pair of flexible arms 36, 38, with each arm 36, 38 having an inwardly tapered end 40. A second portion 28 of the hook and loop fabric fastener pad is attached with adhesive to a top surface 42 of the C-shaped clamp 34. A second hook and loop fabric fastener pad is provided, in which a first portion 44 is attached with adhesive to a bottom surface 46 of the C-shaped clamp 34 and a second portion 48 is attached with adhesive to a top surface 30 of the seat 22 of the high chair 24. A third hook and loop fabric fastener pad is provided in which a first portion is attached with adhesive to a tapered end 40 of a first arm 36 of the C-shaped clamp 34. A second portion 52 is attached with adhesive to a first side surface of the seat 22 of the high chair 24. A fourth hook and loop fabric fastener pad is provided, in which a first portion 56 is attached with adhesive to a tapered end 40 of a second arm 38 of the C-shaped clamp 34. A second portion 58 is attached with adhesive to a second side surface 60 of the seat 22 of the high chair 24. When the infant 14 sits thereon the C-shaped clamp 34 will be retained in its lowered portion on the seat 22.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A high chair safety pants which comprises:

a) a pair of pants for an infant;

b) a first fastener member applied to the bottom surface of said pair of pants;

c) a second fastener member applied to a seat of a high chair, which engages with said first fastener member to prevent said pair of pants with the infant from sliding off the seat of the high chair and injuring the infant; wherein said first fastener member is a first portion of a hook and loop fabric fastener pad attached with adhesive to the bottom surface of said pair of pants wherein said second fastener member includes:

d) a C-shaped clamp having a pair of flexible arms, with each said arm having an inwardly tapered end;

e) a second portion of said hook and loop fabric fastener pad attached with adhesive to a top surface of said C-shaped clamp;

f) a second hook and loop fabric fastener pad, in which a first portion is attached with adhesive to a bottom surface of said C-shaped clamp and a second portion is attached with adhesive to a top surface of the seat of the high chair;

g) a third hook and loop fabric fastener pad, in which a first portion is attached with adhesive to a tapered end of a first arm of said C-Shaped clamp and a second portion is attached with adhesive to a first side surface of the seat of the high chair; and h) a fourth hook and loop fabric fastener pad, in which a first portion is attached with adhesive to a tapered end of a second arm of said C-shaped clamp and second portion is attached with adhesive to a second side surface of the seat of the high chair, so that when the infant sits thereon, said C-shaped clamp will be retained in its lowered position on the seat.

* * * * *